US005426012A

United States Patent [19]

Yokoya et al.

[11] Patent Number: 5,426,012

[45] Date of Patent: Jun. 20, 1995

[54] ELECTROPHOTOGRAPHIC PRINTING PLATE PRECURSOR

[75] Inventors: Hiroaki Yokoya; Hiromichi Tachikawa; Syu Watarai, all of Kanagawa, Japan

[73] Assignee: Fuji Photo Film Co., Ltd., Kanagawa, Japan

[21] Appl. No.: 466,905

[22] Filed: Jan. 18, 1990

[30] Foreign Application Priority Data

Jan. 18, 1989 [JP] Japan ..... 1-9502

[51] Int. Cl.[6] ..... G03G 15/09

[52] U.S. Cl. ..... 430/83; 430/56; 430/59

[58] Field of Search ..... 430/56, 59, 83

[56] References Cited

U.S. PATENT DOCUMENTS 4,882,248 11/1989 Yamada et al. ..... 430/56
5,035,969 7/1991 Kondo et al. ..... 430/83
5,063,129 11/1991 Yokoya et al. ..... 430/83

*Primary Examiner*—S. Rosasco
*Attorney, Agent, or Firm*—Sughrue, Mion, Zinn, Macpeak & Seas

[57] ABSTRACT

An electrophotographic printing plate precursor is disclosed, which comprises an electrically conductive support having thereon a photoconductive layer containing a photoconductive pigment and binder resin which is designated to undergo an electrophotographic process wherein a toner image is formed and the photoconductive layer in the non-image portion other than the toner image portion is then removed to form a printing plate, wherein said photoconductive pigment is a phthalocyanine pigment and said photoconductive layer further comprises at least one compound selected from the compounds represented by the formulae (I), (II) and (III):

(I)

(II)

(III)

wherein Z represents a sulfur atom or an oxygen atom, $R^1$ represents an alkyl group, an alkoxy group, a single ring or double condensed ring aryl group, a single ring or a double condensed ring aryloxy group, or a univalent group derived from a heterocyclic ring, and the two $R^1$ groups in general formula (III) may be the same or different;

$R^2$ and $R^3$ each represent a hydrogen atom, an alkyl group, a single ring or double condensed ring aryl group, or a univalent group derived from a heterocyclic ring, and $R^2$ and $R^3$ may be the same or different;

$R^4$ represents a methylene group, a polymethylene group, a branched alkanediyl group or an arylene group, and $R^1$ and $R^2$, or $R^2$ and $R^3$ may be bonded together.

7 Claims, 1 Drawing Sheet

ELECTROPHOTOGRAPHIC PRINTING PLATE PRECURSOR

FIELD OF THE INVENTION

This invention concerns a novel electrophotographic printing plate precursor having a photoconductive layer containing a phthalocyanine pigment as the photoconductive pigment. Printing plates are made therefrom by forming a toner image by means of an electrophotographic technique and then removing the photoconductive layer in the non-image parts other than the toner image parts (referred to hereinafter as etching). The printing plate precursor of the present invention has improved electrophotographic sensitivity.

BACKGROUND OF THE INVENTION

PS plates containing a positive type photosensitizing agent comprising a diazo compound and a phenolic resin as main components, or containing a negative type photosensitizing agent comprising an acrylic monomer or pre-polymer as main components, are in use today as lithographic offset printing plate precursors. However, these plate precursors have a low sensitivity, and in all cases, plate making is carried out using a contact exposure with a film original on which the image has been previously recorded. On the other hand, as a result of the progress which has been made with computer image processing and high capacity data storage and data communication techniques, computers have been used in recent years for all stages from original input through correction, and editing, layout and paging. The information is then forwarded to remote terminal plotters in real time, using high speed communication networks or satellite communications, to put such systems into practical operation. Electronic editing systems are required in particular in the newspaper printing field where real time characteristics are essential. Furthermore, even in those fields where the original is stored in the form of a film original and a plurality of printing plates are made on the basis of this original, it is thought that the original may be digitally stored as a result of the development of ultra-high capacity recording media such as optical disks, for example.

However, direct type printing plate precursors wherein a printing plate is made directly from the output of a terminal plotter are still impractical. Even when an electronic compilation system has been used, the output is transferred to a silver salt photographic film. The printing plates are then made indirectly using these films, by contact exposure on PS plates. One reason for employing a contact exposure is that it has proved difficult to develop direct type printing plate precursors having a high enough sensitivity to enable a printing plate to be made within a practical period of time using the light source of an output plotter (for example, a He—Ne laser or a semiconductor laser).

Electrophotographic photoreceptors are considered to be photosensitive bodies having a sufficiently high photosensitivity for use in providing direct type printing plates. Many electrophotographic printing plate precursors wherein a toner image is formed and the photoconductive layer is subsequently removed from the non-image parts are known in the art. For example, electrophotographic printing plate precursors have been disclosed, for example, in JP-B-37-17162, JP-B-38-6961, JP-B-38-7758, JP-B-41-2426, JP-B-46-39405, JP-A-50-19509, JP-A-50-19510, JP-A-52-2437, JP-A-54-145538, JP-A-54-134632, JP-A-55-105254, JP-A-55-153948, JP-A-55-161250, JP-A-56-107246, JP-A-147656 and JP-A-57-161863. (The terms "JP-A" and "JP-B" as used herein signify an "unexamined published Japanese patent application" and an "examined Japanese patent publication", respectively.)

Electrophotographic printing plate precursors containing an oxazole compound as an organic photoconductive compound in an aqueous alkaline or alcoholic solution soluble binder resin, and a photoconductive layer obtained by adding a sensitizing dye to this mixture and then coating onto an aluminum plate have been disclosed in JP-A-56-107246. Furthermore, electrophotographic printing plate precursors which contain oxadiazole compounds as organic photoconductive compounds, poly-condensed ring quinone pigments as charge generating agents for these compounds, and alkali soluble carboxyl group containing polymers have been disclosed in JP-A-56-146145. Moreover, electrophotographic printing plate precursors which contain hydrazone compounds as organic photoconductive compounds and which contain pigments such as phthalocyanine pigments or quinacridone pigments, or dyes, as charge generating agents for these compounds and binder resins which are soluble in aqueous or alcoholic solvents have been disclosed in JP-A-62-54266.

It is usually necessary to remove the non-image parts with an alkaline etching fluid and to expose a hydrophilic surface when electrophotographic photoreceptors of this type are used as printing plates. Thus, a binder resin which is soluble in alkaline solvents or which is swelled and removed by alkaline solvents is often used as the binder resin. However, in comparison to the polycarbonate resins, for example, which are widely used as binder resins for electrophotographic photoreceptors, the resins which are dissolved in, or swelled by, alkaline solvents generally have poor compatibility with most organic photoconductive compounds such as the oxazoles, hydrazones, oxadiazoles and pyrazolines, for example. Consequently, where the above-described compounds are dissolved and included in a printing plate, the organic photoconductive compounds tend to separate and precipitate upon storage. Furthermore, these organic photoconductive compounds have poor solubility in the etching fluid such that the washing out or etching properties of the non-image parts with the etching fluid is inadequate. A further disadvantage is that base staining occurs in the white base parts when printing is carried out.

Moreover, as shown in the Examples described hereinafter, electrophotographic printing plate precursors which contain organic photoconductive compounds generally have poor charging properties and charge retention properties in the dark. Consequently, the potential difference between the image portions and the non-image portions is reduced such that toner development may become inadequate, and the available time between charging and development is limited. As a result, such electrophotographic printing plate precursors are of little practical value. Thus, there are various problems associated with electrophotographic printing plate precursors which contain organic photoconductive compounds dissolved in a binder resin.

Moreover, there are also electrophotographic printing plate precursors in which the organic photoconductive compound is not dissolved in the binder resin as described above. This type of electrophotographic printing plate precursor has a photoconductive layer in which an organic photoconductive pigment such as a phthalocyanine pigment is dispersed in an aqueous alkaline or alcoholic solution soluble binder resin. For example, electrophotographic printing plate precursors having a photoconductive layer comprising a phthalocyanine pigment dispersed in a phenolic resin and provided on an aluminum plate have been disclosed in JP-A-55-105254 and JP-A-55-161250, but the sensitivity of these plate precursors is inadequate. Electrophotographic photoreceptors of this type wherein a phthalocyanine pigment is dispersed in a binder resin and not containing organic photoconductive compounds such as hydrazone compounds and oxazole compounds, exhibit an induction effect which reduces the sensitivity, as described in *Current Problems in Electrophotography*, Weigl, p. 278, Walter de Gruyter (1972). Furthermore, it is also known that this induction effect can be reduced and the sensitivity can be increased by adding electron attracting compounds such as tetranitrofluorenones and trinitrofluorenones, for example, to the photoreceptor, as described in *Denshi Shasshin Gakkaishi* 60, 116, 20 (1982). However, these electron attracting compounds are toxic and are difficult to use in practice.

The development of electrophotographic printing plate precursors having a high sensitivity, good storage properties, and good etching properties, has been desired for overcoming the above-described problems.

SUMMARY OF THE INVENTION

An object of the present invention is to provide an electrophotographic printing plate precursor which is improved with respect to the above described disadvantages of conventional printing plate precursors, and which have a high sensitivity, good storage stability, good etching properties and which give rise to little print staining.

Thus, as a result of extensive research, the present inventors have discovered that the aforementioned objectives are attained by providing an electrophotographic printing plate precursor comprising an electrically-conductive support having thereon a photoconductive layer containing a photoconductive pigment and a binder resin which is designated to undergo an electrophotographic process wherein a toner image is formed and the photoconductive layer in the non-image portion other than the toner image portion is then removed to form a printing plate, wherein the photoconductive pigment is a phthalocyanine pigment and the photoconductive layer further comprises at least one type of compound selected from the compounds represented by the general formulae (I), (II) and (III):

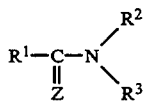

General Formula (I)

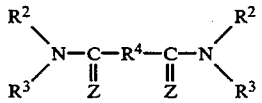

General Formula (II)

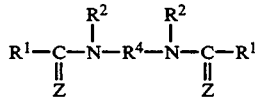

General Formula (III)

In general formulae (I)–(III), Z represents a sulfur atom or an oxygen atom, $R^1$ represents an alkyl group, an alkoxy group, a single ring or double condensed ring aryl group, a single ring or a double condensed ring aryloxy group, or a univalent group derived from a heterocyclic ring, and these groups may be substituted with substituent groups. The two $R^1$ groups in general formula (III) may be the same or different.

$R^2$ and $R^3$ each represent a hydrogen atom, an alkyl group, a single ring or double condensed ring aryl group, or a univalent group derived from a heterocyclic ring, and these groups may be substituted with substituent groups. $R^2$ and $R^3$ may be the same or different.

$R^4$ represents a methylene group, a polymethylene group, a branched alkanediyl group or an arylene group.

$R^1$ and $R^2$, or $R^2$ and $R^3$ may be joined together.

BRIEF DESCRIPTION OF THE DRAWING

The FIGURE shows the surface potential reduction curves of electrophotographic printing plate precursors.

(A) in the FIGURE is the surface potential reduction curve for Example 1 of the invention, (B) is the surface potential reduction curve for Comparative Example 1, and (C) is the surface potential reduction curve for Comparative Example 2.

DETAILED DESCRIPTION OF THE INVENTION

Figure 1:
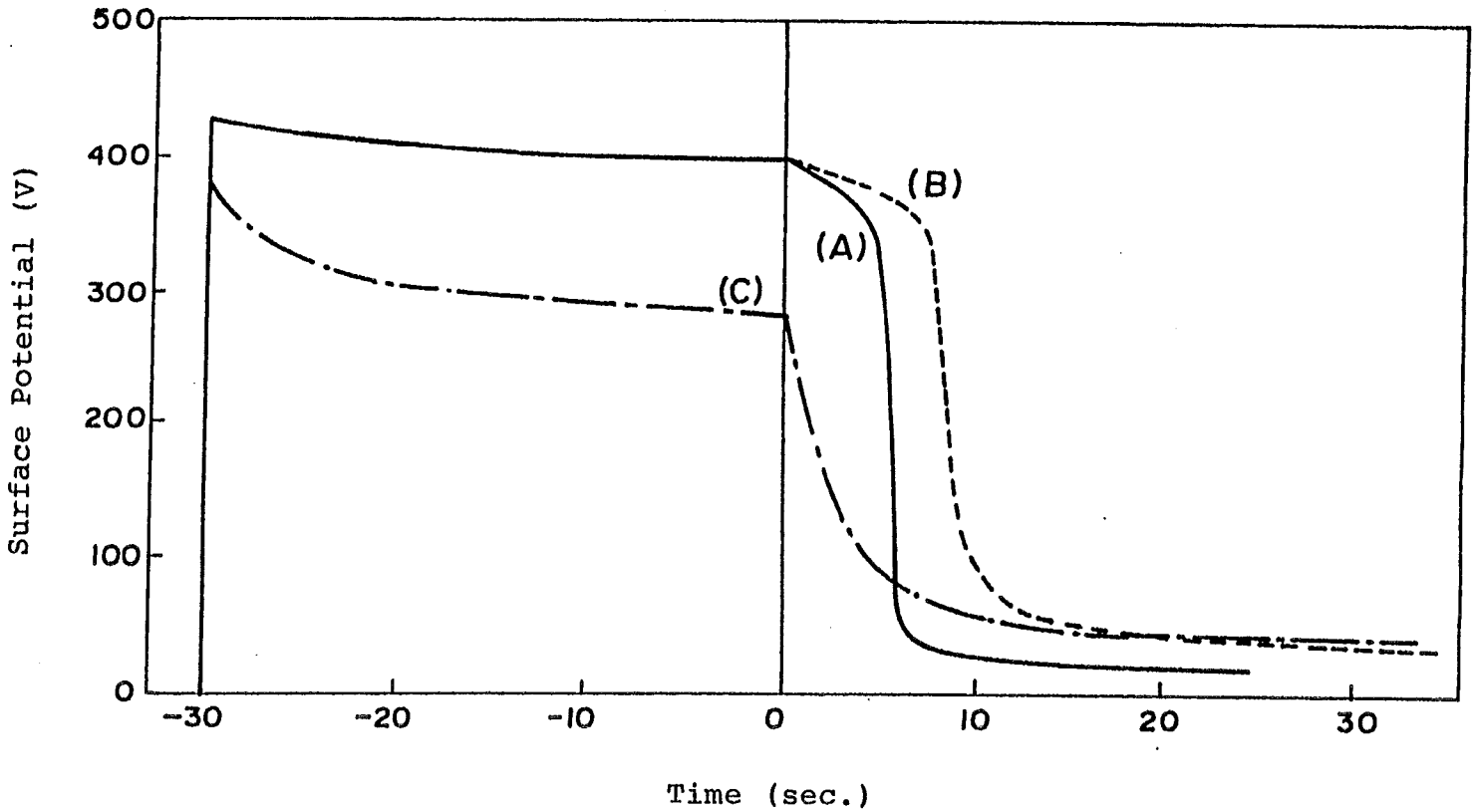

A first component of the photoconductive layer of the electrophotographic printing plate precursor of the present invention is a photoconductive pigment. The phthanlocyanine pigments are many and varied, and include those which have different central metals, those which have different crystalline forms and those which have substituent groups on the benzene ring, for example. Various non-metal phthalocyanines and metal phthalocyanines which have copper, nickel, iron, vanadium, aluminum, gallium, indium, silicon, titanium, magnesium, cobalt, platinum or germanium, for example, as the central metal are known. Phthalocyanines of various different crystalline form which can be distinguished using X-ray crystal diffraction are known among these metal and non-metal phthalocyanines. For example, the copper phthalocyanines have many forms including the $\alpha$-, $\beta$-, $\gamma$-, $\delta$-, $\epsilon$-, $\eta$-, and $\rho$-, forms, the non-metal phthalocyanines have many forms including the $\alpha$-, $\beta$-, $\chi$- and $\tau$- forms, and titanyl phthalocyanine is known to have the $\alpha$-, $\beta$-, m- and other forms. Substituted phthalocyanines in which the benzene rings of the phthalocyanines are substituted with substituent group, such as halogen atoms (e.g., fluorine, chlorine or bromine), alkyl groups, carboxyl groups, amido groups, sulfonyl groups or other substituent groups are also known. For example, the non-metal phthalocyanines are disclosed, for example, in JP-B-44-14106, JP-B-45-8102, JP-B-46-42511, JP-B-46-42512, JP-B-49-4338, JP-A-58-182639 and JP-A-62-47054, the copper phthalocyanines disclosed, for example, in JP-A-50-38543, JP-A-50-95852, JP-A-51-108847 and JP-A-51-109841, the titanyl phthalocyanines disclosed, for example, in JP-A-59-49544, JP-A-59-166959, JP-A-62-275272, JP-A-62-286059, JP-A-62-67094, JP-A-63-364, JP-A-63-365, JP-A-63-37163, JP-A-63-57670, JP-A-63-80263, JP-A-63-116158 and JP-A-63-198067, the aluminum phthalocyanines disclosed, for example, in JP-A-57-90058, JP-A-62-163060, JP-A-62-133462, JP-A-62-177069, JP-A-63-

73529 and JP-A-63-43155, the vanadyl phthalocyanines disclosed, for example, in JP-A-57-146255, JP-A-57-147641 and JP-A-57-148747, and the halogenated metal phthalocyanines disclosed, for example, in JP-A-59-44053, JP-A-59-128544, JP-A-59-133550, JP-A-59-133551, JP-A-59-174846, JP-A-59-174847, JP-A-60-59354, JP-A-60-260054, JP-A-60-220958, JP-A-62-229254, JP-A-63-17457, JP-A-59-155851, JP-A-63-27562 and JP-A-63-56564, but the phthalocyanines are not limited to these examples, and the various known phthalocyanines can be used in the present invention. Phthalcyanine pigments have different absorbing wavelengths and are selected in accordance with the intended application, but phthalocyanine pigments which absorb at wavelengths matching semiconductor lasers in the range of from 780 nm to 830 nm have mainly been investigated for electrophotographic purposes. All known phthalocyanine pigments can be used in the present invention.

Electrophotographic printing plate precursors require better charge retention properties than the photoreceptors used in copying machines and photoprinters. Thus, the use of phthalocyanine pigments which have good charge retention properties (the ability to retain a surface charge in the dark), is preferred. Phthalocyanine pigments of this type include, for example, copper phthalocyanines and non-metal phthalocyanines. Furthermore, the ϵ-type copper phthalocyanines disclosed in JP-A-50-38543, and the x-type non-metal phthalocyanines disclosed in JP-B-48-34189 are ideal for use in cases wherein a semiconductor laser is used to expose the printing plate precursor.

The phthalocyanine pigment content of the photoconductive layer is from 3 to 50 wt %, and preferably from 5 to 30 wt %, of the solid fraction of the photoconductive layer.

A second component in the present invention is a binder resin. The binder resin of the present invention is soluble in, or swelled by, the solvent which is used to wash out the non-image parts (which is to say the photoconductive layer), without washing out the toner image parts, but the use of resins which are dissolved in, or swelled by, alcohol and/or alkaline aqueous solutions is preferred. These resins include phenolic resins, styrene/maleic anhydride copolymers, vinyl acetate/crotonic acid copolymers, vinyl acetate/maleic anhydride copolymers, alcohol soluble nylons and copolymers of two or more monomers which have acidic groups, such as acrylic acid, methacrylic acid, crotonic acid or itaconic acid with monomers such as methacrylic acid esters, acrylic acid esters or styrene, for example, but any copolymer which contains acidic groups can be used. The use of the copolymers described below as disclosed in Japanese Patent Application Nos. Sho. 63-87024, 63-156387 and 63-158365 is preferred.

That is to say, the use of the following copolymers is preferred.

(a) Copolymers derived from at least one methacrylic acid ester or acrylic acid ester containing an aromatic ring as a monomer component and at least one vinyl polymerizable compound having an acidic functional group as a monomer component.

(b) Copolymers derived from at least one vinyl ester compound having an aromatic ring as a monomer component and at least one vinyl polymerizable compound having an acidic group as a monomer component.

(c) Copolymers derived from at least one compound obtained by the half esterification of maleic anhydride with an alcohol having an aromatic ring within the alcohol molecule as a monomer component and at least one styrene derivative as a monomer component.

Moreover, copolymers derived from at least one methacrylic acid ester or acrylic acid ester having an aromatic hydrocarbyl ring as a monomer component and at least one vinyl polymerizable compound having an acidic functional group as a monomer component are preferred. In view of the ease with which they can be obtained, the use of copolymers derived from at least one acrylic acid benzyl ester or methacrylic acid benzyl ester as a monomer component and at least one vinyl polymerizable compound having an acidic functional group as a monomer component, for example, a benzyl methacrylate/methacrylic acid copolymer, a benzyl methacrylate/acrylic acid copolymer or a benzyl acrylate/acrylic acid copolymer, is preferred.

These resins can be used individually, or mixtures of two or mores such resins can be used.

No particular limitation is imposed upon the binder resin in the present invention, but the binder resin content is from 97 to 50 wt %, and preferably from 95 to 70 wt %, of the solid fraction of the photoconductive layer.

A third component which constitutes the present photoconductive layer serves as a sensitizing agent which improves the photoconductivity of a photoconductive layer comprising the above-mentioned phthalocyanine pigment and the above-mentioned binder resin. As described above, there is an induction effect which retards the reduction of the surface potential immediately after irradiation with light when a photoconductive layer which does not contain at least one compound selected from the compounds represented by the general formulae (I), (II) and (III), as a third component, and this has the effect of reducing the sensitivity. The factors involved are not clear. It is thought that there are carrier traps on the surface or in the bulk of the phthalocyanine particles, and that the carriers produced by irradiation with light are captured by these carrier traps so that no fall in the surface potential is immediately observed. The sensitizing agents of the present invention reduce the extent of this induction effect, shorten the time period during which there is no reduction in the surface potential (the induction period), to thereby so improve the sensitivity.

In general formulae (I) to (III), the alkyl group for $R^1$ to $R^3$ is a linear chain or branched alkyl group having from 1 to 22, preferably 1 to 12, more preferably 1 to 8 carbon atoms.

In general formulae (I) to (III), the substituted alkyl group for $R^1$ to $R^3$ is a linear chain or branched substituted alkyl group having from 1 to 22, preferably 1 to 12, more preferably 1 to 8 carbon atoms to which from one to three halogen atoms (for example, chlorine, bromine, or fluorine), cyano groups, nitro groups, phenyl groups or tolyl groups are bonded as substituent groups.

The alkoxy group or substituted alkoxy group for $R^1$ which incorporates the above described alkyl groups or substituted alkyl groups (e.g., methoxy, ethoxy, n-propoxy, iso-propoxy).

In those cases where any of the groups $R^1$ to $R^3$ is a single ring or double condensed ring aryl group, the aryl group can be, for example, a phenyl group, a naphthyl group, an anthranyl group, a biphenyl group, or a phenanthryl group.

In those cases where any of the groups $R^1$ to $R^3$ is a substituted single ring or a substituted double condensed ring aryl group, the group can be, for example, a phenyl group, a naphthyl group, an anthranyl group, a biphenyl group, or a phenanthryl group which is substituted with from one to three halogen atoms (for example chlorine, bromine, or fluorine), cyano groups, nitro groups, linear chain or branched alkyl groups having form 1 to 5 carbon atoms, linear chain or branched alkoxy groups having from 1 to 5 carbon atoms, alkoxycarbonyl groups having linear chain or branched alkyl groups containing from 1 to 5 carbon atoms, or acyl groups having linear chain or branched alkyl groups containing from 1 to 5 carbon atoms as substituent groups.

In those cases where $R^1$ represents a substituted or unsubstituted single ring or double condensed ring aryloxy group, it can be an aryloxy group (e.g., phenoxy, naphthoxy) having one of the above described substituted or unsubstituted single ring or double condensed ring aryl groups.

In those cases where any of the groups $R^1$ to $R^3$ is a univalent group derived from a single ring or double condensed ring heterocyclic ring, it can be, for example, pyrrolidinyl group, piperidinyl group, piperidino group, morpholinyl group, morpholino group, pyrrolyl group, imidazolyl group, pyridyl group, pyrimidyl group, indolinyl group, isoindolinyl group, indolyl group, isoindolyl group, benzimidazolyl group, quinolyl group or an isoquinolyl group.

In those cases where the groups $R^1$ to $R^3$ are univalent groups derived from single ring or double condensed ring heterocyclic rings which have substituent groups, they are univalent groups derived from single ring or double condensed ring heterocyclic rings which are substituted with from one to three halogen atoms (for example, chlorine, bromine, or fluorine), cyano groups, nitro groups, phenyl groups, tolyl groups, benzyl groups, phenethyl groups or linear chain or branched alkyl groups having from 1 to 5 carbon atoms as substituent groups.

In those cases where $R^1$ and $R^2$, or $R^3$ and $R^4$, are joined together, a polymethine group, oxydipolymethine group or halogenated product thereof can be used as a linkage group. The resulting joined group may be, for example, a trimethylene group, a tetramethylene group, a pentamethylene group or an oxydiethylene group ($—CH_2—CH_2—O—CH_2—CH_2—$), or a divalent group wherein from 1 to 3 of the hydrogen atoms of the divalent group have been replaced by halogen atoms (for example, chlorine, bromine, or fluorine), cyano groups, nitro groups, phenyl groups, tolyl groups, benzyl groups, phenethyl groups or linear chain or branched alkyl groups having from 1 to 5 carbon atoms.

In those cases where $R^1$ to $R^3$ are alkyl groups, aryl groups or univalent groups derived from heterocyclic rings having two or three substituent groups, and those cases wherein $R^1$ is an alkoxy group or an aryloxy group, any combination of substituent groups can be used.

Where $R^4$ is a polymethylene group, it is, for example, a polymethylene group having from 2 to 22, preferably 2 to 12, more preferably 2 to 8 carbon atoms. Where $R^4$ is a branched alkanediyl group, it can be, for example, a branched alkanediyl group having from 3 to 22, preferably 3 to 12, more preferably 3 to 8 carbon atoms which has single free atomic valency at each of two carbon atoms in any two positions. In those cases where $R^4$ is an arylene group, it can be, for example, an o-, m- or p-phenylene group or a naphthylene group having a single free atomic valency at each of two carbon atoms in any two positions.

Useful examples of compounds represented by the general formulae (I) to (III) are indicated below, but the invention is not limited to the use of these compounds.

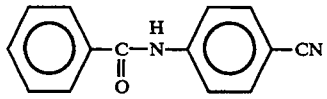

Illustrative Compound (1)

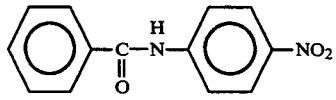

Illustrative Compound (2)

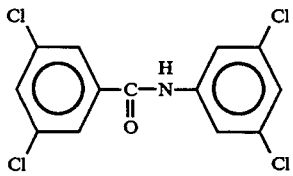

Illustrative Compound (3)

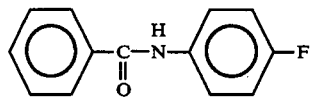

Illustrative Compound (4)

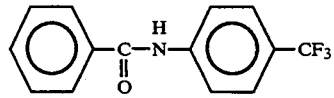

Illustrative Compound (5)

-continued
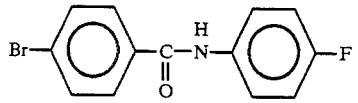
Illustrative Compound (6)
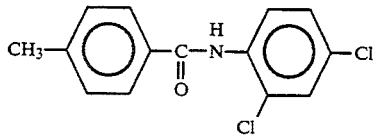
Illustrative Compound (7)
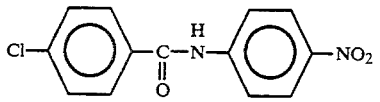
Illustrative Compound (8)
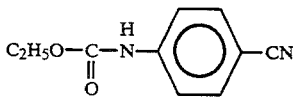
Illustrative Compound (9)
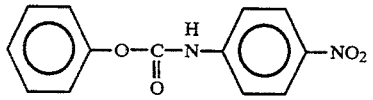
Illustrative Compound (10)
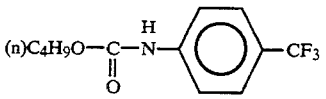
Illustrative Compound (11)
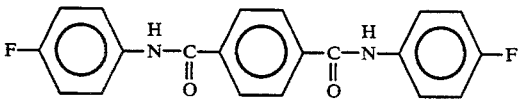
Illustrative Compound (12)
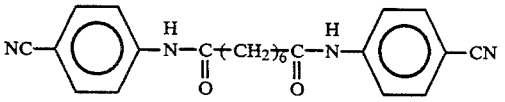
Illustrative Compound (13)
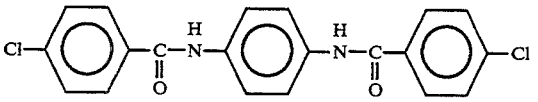
Illustrative Compound (14)
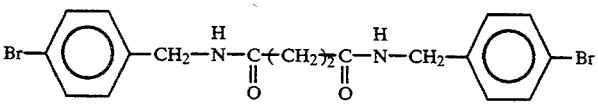
Illustrative Compound (15)
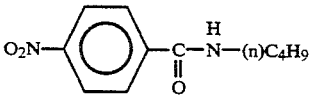
Illustrative Compound (16)
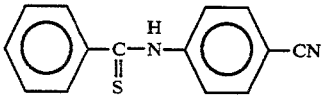
Illustrative Compound (17)
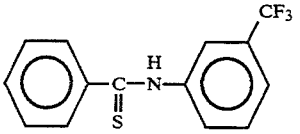
Illustrative Compound (18)

-continued
Illustrative Compound (19)
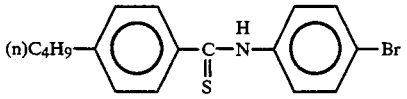
Illustrative Compound (20)
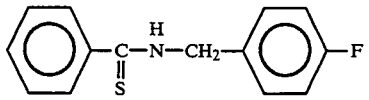
Illustrative Compound (21)
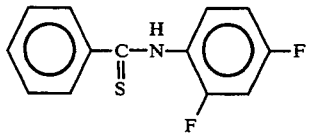
Illustrative Compound (22)
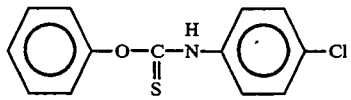
Illustrative Compound (23)
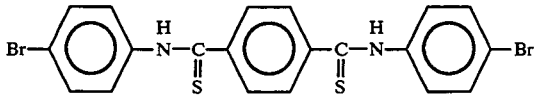
Illustrative Compound (24)
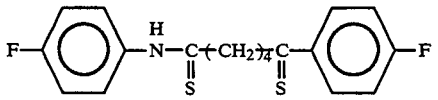
Illustrative Compound (25)
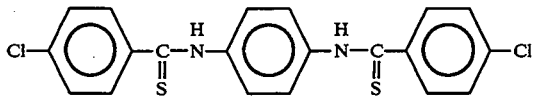
Illustrative Compound (26)
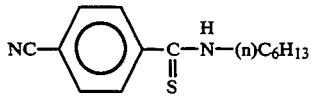
Illustrative Compound (27)
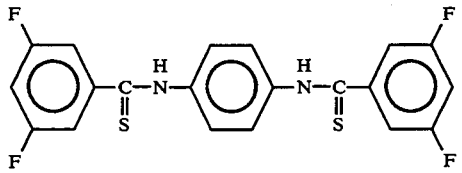
Illustrative Compound (28)
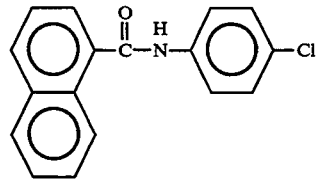
Illustrative Compound (29)
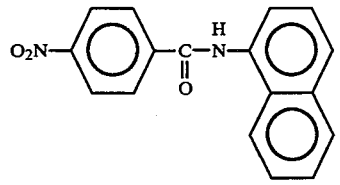

-continued

Illustrative Compound (30)

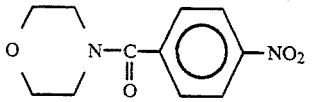

The urea and thiourea compounds represented by general formulae (I) to (III) in the present invention are readily prepared using the methods described on page 262 of *Beilsteins Handbuch der Organichen Chemie*, volume 12.

The use of compounds represented by the general formulae (I) to (III) of the present invention in electrophotographic photoreceptors are disclosed, for example, in JP-A-58-102239 and JP-A-58-103340. However, in the above patent publications, the compounds are used as sensitizing agents which further sensitize organic photoconductors which have been sensitized with a dye, and the sensitivity increasing effect on photoreceptors in which dye sensitization has not been carried out as in the present invention is not disclosed. Furthermore, the above patent publications are silent with respect to the use of the phthalocyanine pigments which form the photoconductive pigments in the present invention. Furthermore, the use of zinc oxide which is an inorganic photoconductive pigment is disclosed in connection with the use of photoconductive pigments in the above patent publications, and the sensitizing agents were only known to have an effect in those cases in which an inorganic photoconductor such as zinc oxide, for example, had been dye sensitized.

Moreover, the use of compounds represented by the general formulae (I) to (III) of the present invention in electrophotographic printing plate precursors has been disclosed by the present inventors in Japanese Patent Application Nos. Sho. 63-43509, 63-41279, 63-43511, 63-41278, 63-41276 and 63-41277, but these specifications all relate to electrophotographic printing plate precursors which have photoconductive layers which contain organic photoconductive compounds which have been sensitized with specified dyes. The constitution is different from that of the electrophotographic printing plate precursors of the present invention which do not contain dye sensitizing agents.

Hence, the fact that the compounds of the present invention have the effect of reducing the characteristic induction effect of the phthalocyanine pigment photoreceptors of the present invention wherein an organic photoconductive compound is not dissolved in the binder resin, could not have been predicted on the basis of the above described past findings.

No limitation is imposed upon the addition amount of the compound represented by general formulae (I) to (III) but the amount added is preferably within the range of from 1 to 100 wt % with respect to the phthalocyanine pigment content. The compounds are most desirably added in an amount within the range of from 2 to 40 wt % with respect to the phthalocyanine pigment content.

Various known additives which have conventionally been used in electrophotographic photoreceptors can be used in addition to the compounds of the present invention in the photoconductive layers of the electrophotographic printing plate precursor of the present invention. These additives include chemical sensitizing agents for improving the electrophotographic sensitivity and various plasticizers, and surfactants for improving film forming properties. Examples of chemical sensitizing agents include electron withdrawing compounds such as p-benzoquinone, chloranil, fluoranil, bromanil, dinitrobenzene, anthraquinone, 2,5-dichlorobenzoquinone, nitrophenol, tetrachlorophthalic anhydride, 2,3-dichloro-5,6-dicyanobenzoquinone, dinitrofluorenone, trinitrofluorenone and tetracyanoethylene.

Dimethyl phthalate, dibutyl phthalate, dioctyl phthalate, triphenyl phosphate, diisobutyl adipate, dimethyl sebacate, dibutyl sebacate, butyl laurate, methyl phthalyl ethyl glycolate and dimethylglycol phthalate, for example, can be added as plasticizers in order to improve the flexibility of the photocinductive layer. These plasticizers can be added in an amount such that there is no deterioration in the electrostatic properties and etching properties of the photoconductive layer.

Furthermore, if the photoconductive layer of the present invention is too thin it cannot be charged to the surface potential required for development, whereas if it is too thick, side etching undersirably occurs. The thickness of the photoconductive layer is from 0.1 to 30 $\mu$, and preferably from 0.5 to 10 $\mu$.

Electrically conductive supports which have a hydrophilic surface, for example plastic sheets which have an electrically conductive surface, or solvent impermeable and electrically conductive papers, and aluminum sheets, zinc sheets, bimetal sheets (e.g., copper-/aluminum sheets, copper/stainless steel sheets, chromium/copper sheets), or trimetal sheets (e.g., chromium/-copper/aluminum sheets, chromium/lead/iron sheets, chromium/copper/stainless steel sheets) can be used as the electrically conductive support of the present invention, and these preferably have a thickness of from 0.1 to 3 mm, and more preferably have a thickness of from 0.1 to 0.5 mm. From among these supports, the aluminum sheets are preferred. The aluminum sheets for use in the present invention are of pure aluminum or aluminum alloy containing traces of different atoms but of which aluminum is the main component. Conventional supports for electrophotographic purposes can be used in the present invention.

The aluminum sheet as a support can be used after sanding and anodic oxidization using conventional methods. A de-greasing treatment with a surfactant or an aqueous alkaline solution as needed may be carried out prior to sanding in order to remove the rolling grease from the surface of the aluminum sheet, and then a sanding treatment is carried out. The sanding treatment can be carried out using methods wherein the surface is roughened mechanically, using methods wherein the surface is dissolved away electrochemically, or using methods wherein the surface is selectively dissolved away chemically. Known mechanical methods of roughening the surface, such as ball polishing methods, brush polishing methods, blast polishing methods and buff polishing methods, can be used. The passage of an alternating current or a direct current in a hydrochloric acid or nitric acid electrolyte can be used for electrochemical roughening purposes. Furthermore, combinations of these methods, as disclosed in JP-A-54-63902, can also be used.

The aluminum sheets which have been roughened in this way can be subjected to an alkali etching treatment or a neutralizing process, as required.

The aluminum sheet which has been treated in this way is subjected to anodic oxidization. Sulfuric acid, phosphoric acid, oxalic acid, chromic acid or mixtures of these acids are used as the electrolyte in the anodic oxidization treatment, and the electrolyte content and concentration is determined appropriately in accordance with the type of electrolyte. The conditions of the anodic oxidization process vary according to the electrolyte which is being used, but generally, terms suitable conditions include the electrolyte concentration is from 1 to 80 wt %, the electrolyte temperature is from 5° C. to 70° C., the current density of from 5 to 60 $A/dm^2$, the voltage is from 1 to 100 V and the electrolysis time is from 10 seconds to 50 minutes. The weight of the anodically oxidized film is preferably from 0.1 to 10 $g/m^2$, and more preferably from 1 to 6 $g/m^2$.

Moreover, the use of supports obtained by subjecting an aluminum sheet to an anodic oxidization process followed by immersion in an aqueous solution of an alkali metal silicate as disclosed in JP-B-47-5125 is preferred. Furthermore, silicate electrodeposition as disclosed in U.S. Pat. No. 3,658,662 is also effective. Treatment with polyvinylsulfonic acid as disclosed in West German Patent Application (OLS) No. 1,621,478 is also appropriate.

Furthermore, an alkali soluble intermediate layer comprised of casein, poly(vinyl alcohol), ethylcellulose, phenolic resin, styrene/maleic anhydride copolymer or poly(acrylic acid), for example, can be established between the electrically conductive support and the photoconductive layer in order to improve adhesion and to improve the electrostatic characteristics of the electrophotographic printing plate precursor in the present invention.

Furthermore, an overcoat layer which is removed at the same time as the photoconductive layer is being removed may be provided, as required, over the photoconductive layer in the present invention in order to improve the electrostatic characteristics, toner development characteristics, or imaging characteristics or printing characteristics. This overcoat layer may be a mechanically matted layer or a resin layer which contains a matting agent. In this case, silicon dioxide, glass particles, alumina, starch, titanium oxide, zinc oxide, particles of polymers such as poly(methyl methacrylate), polystyrene and phenolic resins for example, and the matting agents disclosed in U.S. Pat. Nos. 2,701,245 and 2,992,101 can be included as matting agents. Two or more of these matting agents can be used in combination. The resin which is used for the overcoat layer is selected appropriately in combination with the etching fluid which is to be used to remove the photoconductive layer. Useful examples of such resins for the overcoat layer include gum arabic, glue, celluloses, starches, poly(vinyl alcohol), poly(ethylene oxide), poly(acrylic acid), polyacrylamide, poly(vinyl methyl ether), epoxy resins, phenolic resins, polyamides and poly(vinyl butyrate). Two or more of these resins can be used in combination.

Any of the toners conventionally used as toners for electrophotographic purposes, such as the dry developers and liquid developers which are resistant to the etching fluid and which prevent etching of the photoconductive layer in the toner image parts can be used as the toner in the present invention, but the use of a liquid developer is preferred for obtaining high image resolution. Moreover, toners which are hydrophobic and provide toner image parts which have ink accepting properties are desirable. For example, polymeric materials such as polyestyrene based resins, poly(vinyl toluene) based resins, polyester based resins, acrylic ester or methacrylic ester homopolymers and copolymers, ethylene copolymers, cyclized rubbers, vinyl acetate homopolymers and copolymers, and vinyl chloride polymers can be used as toner particle components. Furthermore, colorants, for example pigments and dyes such as carbon black, nigrosine based pigments, phthalocyanine blue, phthalocyanine green, benzidine yellow, alkali blue and Carmine 6B can also be included within the range where they have no adverse effect on the fixing properties, dispersion properties and etching resistance of the toner. Moreover, various charge adjusting agents and other additives may be included.

Any solvent which is able to remove the photoconductive insulating layer can be used for the etching fluid for removing the photoconductive insulating layer from the non-toner image parts after toner image formation. Although no particular limitation is imposed in this regard, the use of alkaline solvents is preferred. The term "alkaline solvent" as used herein means an aqueous solution containing an alkaline compound, an organic solvent containing an alkaline compound or a mixture thereof. Any organic or inorganic alkaline compound, for example, sodium hydroxide, potassium hydroxide, sodium carbonate, sodium silicate, potassium silicate, sodium metasilicate, potassium metasilicate, sodium phosphate, potassium phosphate, ammonia, or an aminoalcohol such as monoethanolamine, diethanolamine or triethanolamine, can be used as the alkaline component of the alkaline solvent. Water or various organic solvents can be used, as described earlier, for the etching fluid solvent, but the use of etching fluids in which water forms the principal component are preferred with respect to both odor and pollution. Various organic solvents can be added, as required, to an etching fluid in which water is the principal component. Preferred organic solvents include lower alcohols and aromatic alcohols such as methanol, ethanol, propanol, butanol, benzyl alcohol and phenethyl alcohol, ethylene glycol, diethylene glycol, triethylene glycol, polyethylene glycol, cellosolves, and aminoalcohols such as monoethanolamine, diethanolamine and triethanolamine, for example. Furthermore, surfactants, anti-foaming agents, and various other additives, as required, can be included in the etching fluid.

The method by which printing plates are prepared from the electrophotographic printing plate precursor of the present invention is described below. An image is formed on an electrophotographic printing plate precursors of the present invention using a conventional electrophotographic process. In particular, an electrostatic latent image is formed by essentially uniformly charging the printing plate precursor in the dark, and then imagewise exposure to light. The exposure may take the form of reflected imagewise exposure or a contact exposure through a transparent positive image film using xenon lamp, a tungsten lamp or a fluorescent lamp for the light source, or it may take the form of a scanning exposure using laser light or light emitting diodes for example. In the case of a scanning exposure, the exposure can be made using a lasser light source, such as a helium-neon laser, a helium cadmium laser, an argon ion laser, a krypton ion laser, a YAG laser, a ruby laser, a nitrogen laser, a dye laser, an excimer laser, a semiconductor laser such as a GaAs/GaAlAs or InGaAsP laser, an alexandrite laser, a copper vapor laser or an erbium laser for example, or using a light emitting diode or a liquid crystal shutter (including the use of line printer type light sources such as light emitting diode arrays and liquid crystal shutter arrays).

A dry development method (cascade development, magnetic brush development, powder cloud development) or a liquid development method can be used for development of the above described electrostatic latent image with a toner. Of these, the liquid development methods are able to form fine images and are preferred for making printing plates. Moreover, positive-positive development with positive development, and negative-positive development with reverse development with the application of an appropriate bias voltage are possible.

The thus formed toner image can be fixed using conventional fixing methods, including thermal fixing, pressure fixing or solvent fixing, for example. The toner image thus formed is then used as a resist. The printing plate is then formed by removing the photoconductive layer from the non-image parts by means of the etching fluid.

The invention is described in practical terms below by means of following examples, but the invention is not limited by these examples. Moreover, the term "parts" as used in the following examples signifies in all cases "part by weight".

EXAMPLE 1

| | |
|---|---|
| ε-Type copper phthalocyanine (Liophoton ERPC, made by Toyo Ink Mfg. Co., Ltd.) | 3.0 parts |
| Illustrative compound (1) | 0.3 parts |
| Benzyl methacrylate/methacrylic acid copolymer (monomer mol ratio 60:40) | 15.0 parts |
| Tetrahydrofuran | 100 parts |
| Cyclohexanone | 20 parts |

The ingredients indicated above were introduced together with glass beads into a 500 ml capacity glass container and dispersed for 120 minutes in a paint shaker (made by Toyo Seiki Seisakujo K. K.), after which the glass beads were separated by filtration to provide a coating liquid dispersion for the photoconductive layer.

Next, the liquid dispersion for the photoconductive layer was coated onto a sanded aluminum sheet of thickness 0.25 mm and dried to prepare an electrophotographic printing plate precursor having a photoconductive layer of dry film thickness 5.0 μ.

Next, the electrophotographic sensitivity of the electrophotographic printing plate precursor thus obtained was measured. The electrophotographic characteristics were measured by subjecting the thus obtained electrophotographic printing plate precursor to a corona charging process with a +8.0 kV static system using an electrostatic copier paper testing apparatus EPA-8100 (made by Kawaguchi Denki K. K.), and esposing the charged plate with monochromatic light of wavelength 780 nm at an intensity of 10 mW/m$^2$.

The surface potential immediately after charging (V0), the ratio of the surface potential 30 seconds after charging with respect to V0 as the charge retention factor (DD30), the exposure (E50) required to reduce the surface potential by one-half, and the exposure (E80) required to reduce the surface potential to one fifth were obtained, with the following results:

| | |
|---|---|
| VO | +460 V |
| E50 | 6.1 μJ/cm$^2$ |
| E80 | 7.0 μJ/cm$^2$ |
| DD30 | 92% |

Next, the sample was charged in the dark to a surface potential of +450 V. The sample was then exposed with light of wavelength 780 nm using a semiconductor laser to provide an exposure at the plate surface of 8.0 μJ/cm$^2$. Next, the sample was developed using a liquid developer, prepared by dispersing 5 grams of poly(methyl methacrylate) particles (average particle size 0.3 μ) as toner particles in 1 liter of "Isoper H" ((Esso Standard Co.) and adding 0.01 gram of soybean oil lecithin as a charge adjusting agent, with the application of a 40 V bias voltage to a counter-electrode, and a clear positive toner image was obtained.

Moreover, the toner image was fixed by heating to 120° C. for 30 seconds. The non-image parts of the electrophotographic printing plate precursor were removed using an etching fluid obtained by diluting 40 parts of potassium silicate, 10 parts of potassium hydroxide and 100 parts of ethanol with 800 parts of water, after which the plate was washed adequately with water. An offset printing plate was finally obtained by gumming.

The printing plate so obtained was used in a Hamada Star 600 CD offset printing machine and 50,000 very clear printed clear copies were obtained by printing in a normal manner with no staining in the non-image parts.

Furthermore, the printing plate precursors of the present invention thus prepared were useable with no particular difficulty after being stored for 3 months under conditions of 35° C., 80%.

COMPARATIVE EXAMPLE 1

An electrophotographic printing plate precursor was prepared in the same manner as in Example 1, except that the illustrative compound (1) was not included. The electrophotographic characteristics were measured in the same manner as Example 1. The results obtained were as follows:

| | |
|---|---|
| VO | +445 V |
| E50 | 9.0 μJ/cm$^2$ |
| E80 | 10.6 μJ/cm$^2$ |
| DD30 | 93% |

The induction effect was larger than in Example 1, and the sensitivity of the printing plate precursor thus prepared was reduced.

COMPARATIVE EXAMPLE 2

An electrophotographic printing plate precursor was made in the same manner as in Example 1, except that 5 parts of the hydrazone compound indicated below was added as an organic photoconductive compound instead of illustrative compound (1). The electrophotographic characteristics were measured as in Example 1, with the results indicated below.

| Hydrazone Compound |
|---|

-continued

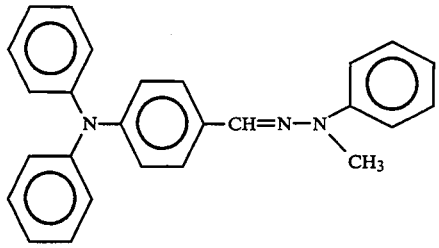

| | |
|---|---|
| V0 | +380 V |
| E50 | 3.5 μJ/cm² |
| E80 | 12.6 μJ/cm² |
| DD30 | 75% |

The charging properties of the thus prepared printing plate precursor were worse than the those of Example 1, and the charge retention properties were also poorer. There was no induction effect, but the reduction in the surface potential was slow and the tone reproduction properties were soft. Consequently, the sensitivity (E80) which is an evaluation of practical sensitivity was worse than that of the electrophotographic printing plate precursor of Example 1.

Next, this sample was charged in the dark to a surface potential of +390 V and then exposed with light of wavelength 780 nm using a semiconductor laser such that the exposure intensity at the plate surface was 10.0 μJ/cm². The sample was then toner developed and etched, and printing was carried out, in the same manner as in Example 1, but in this case, the printed material thus obtained was stained in the non-image etched areas.

Furthermore, the hydrazone organic photoconductive compound precipitated out on the surface of the electrophotographic printing plate precursor after storing for 3 months under conditions of 35° C., 80%.

The measured electrophotographic characteristics of the electrophotographic printing plate precursors of Example 1 and Comparative Examples 1 and 2 are shown in the FIGURE. These measurements were made using the method described in Example 1. (A) in the FIGURE is the surface potential reduction curve for the electrophotographic printing plate precursor of the invention of Example 1, (B) in the FIGURE is the surface potential reduction curve for the electrophotographic printing plate precursor of Comparative Example 1, and (C) in the FIGURE is the surface potential reduction curve for the electrophotographic printing plate precursor of Comparative Example 2.

The dark reduction is shown from −30 seconds to 0 seconds in the FIGURE, and the surface potential reduction curve with photo-reduction is shown from 0 seconds to 30 seconds.

In comparison with the electrophotographic printing plate precursor of Comparative Example 1, the plate precursor of Example 1 of the invention clearly had a smaller induction effect (i.e., faster initial surface potential reduction). Moreover, the addition of illustrative compound (1) had no adverse effect on the charging properties or charge retention properties, and did not result in a loss of contrast characteristics.

Although the electrophotographic printing plate precursor of Comparative Example 2 did not exhibit an induction effect, photo-reduction was slow, and the actual sensitivity was lower than that of the plate precursor of Example 1. Moreover, the charging properties and charge retention properties were also poor.

EXAMPLES 2–12

Electrophotographic printing plate precursors of the invention were prepared in the same manner as in Example 1, except that the compounds shown in Table 1 were used instead of the illustrative compound (1) of Example 1, and the electrophotographic characteristics were measured in the same manner as in Example 1 in each case. The results thus obtained are shown in Table 1.

TABLE 1

| | Illustrative Compound | VO (V) | DD30 (%) | E50 (μJ/cm²) | E80 (μJ/cm²) |
|---|---|---|---|---|---|
| Example 2 | (2) | 460 | 91 | 6.0 | 6.5 |
| Example 3 | (3) | 447 | 91 | 6.5 | 7.2 |
| Example 4 | (4) | 448 | 92 | 6.8 | 7.8 |
| Example 5 | (5) | 450 | 93 | 7.1 | 7.9 |
| Example 6 | (8) | 460 | 90 | 6.5 | 7.0 |
| Example 7 | (9) | 445 | 92 | 7.2 | 7.8 |
| Example 8 | (10) | 449 | 91 | 7.1 | 7.9 |
| Example 9 | (12) | 438 | 92 | 6.8 | 7.6 |
| Example 10 | (14) | 448 | 92 | 6.5 | 7.4 |
| Example 11 | (17) | 439 | 91 | 7.0 | 7.8 |
| Example 12 | (23) | 451 | 93 | 7.2 | 7.7 |

EXAMPLE 13

An electrophotographic printing plate precursor was made in the same manner as in Example 1, except that an x-type non-metal phthalocyanine (Fastogen Blue 8120, made by Dainippon Ink & Chemicals, Inc.) was used for the phthalocyanine pigment, and the electrophotographic characteristics were measured in the same manner as in Example 1 with the following results:

| | |
|---|---|
| VO | +440 V |
| E50 | 1.5 μJ/cm² |
| E80 | 1.8 μJ/cm² |
| DD30 | 92% |

This sample was then charged in the dark to a surface potential of +450 V, after which it was exposed with light of wavelength 780 nm using a semiconductor laser to provide an exposure intensity at the plate surface of 2.0 μJ/cm². The plate was then toner developed and etched, and printing was carried out, in the same manner as in Example 1. Fifty thousand very clear printed copies with no staining in the non-image parts were obtained.

Furthermore, the plates were used without difficulty after storage for 3 months under conditions of 35° C., 80%.

EXAMPLE 14

An electrophotographic printing plate precursor was made in the same manner as in Example 1, except that an x-type non-metal phthalocyanine (Fastogen Blue 8120, made by Dainippon Ink & Chemicals, Inc.) was used instead of the ε-type copper phthalocyanine for the phthalocyanine pigment, and a vinyl benzoate/crotonic acid copolymer (monomer composition mol ratio 60:40) was used instead of the benzyl methacrylate/methacrylic acid copolymer as the binder resin. The electrophotographic characteristics of the printing plate precursor thus prepared were measured in the same manner as in Example 1 with the following results:

| | |
|---|---|
| VO | +430 V |
| E50 | 1.6 $\mu J/cm^2$ |
| E80 | 1.9 $\mu J/cm^2$ |
| DD30 | 90% |

This sample was then charged in the dark to a surface potential of +450 V, after which it was exposed with light of wavelength 780 nm using a semiconductor laser to provide an exposure intensity at the plate surface of 3.0 $\mu J/cm^2$. The plate was then toner developed and etched, and printing was carried out in the same manner as in Example 1. Fifty thousand very clear printed copies with no staining in the non-image parts were obtained.

Furthermore, the plates thus obtained were used without particular difficulty after storage for 3 months under conditions of 35° C., 80%.

The present invention provides electrophotographic printing plate precursors having a high sensitivity, excellent charging properties, excellent charge retaining characteristics in the dark and excellent tone reproduction characteristics, and which are excellent as photoreceptors for plate making purposes. Furthermore, the etching properties are also good, and the electrophotographic printing plate precursors of the present invention have excellent ageing stability.

While the invention has been described in detail and with reference to specific embodiments thereof, it will be apparent to one skilled in the art that various changes and modifications can be made therein without departing from the spirit and scope thereof.

What is claimed is:

1. An electrophotographic printing plate precursor comprising an electrically conductive support having thereon a photoconductive layer containing a photoconductive pigment that is not dye sensitized and binder resin which is designated to undergo an electrophotographic process wherein a toner image is formed and the photoconductive layer in the non-image portion other than the toner image portion is then removed to form a printing plate, wherein said photoconductive pigment is a phthalocyanine pigment and said photoconductive layer further comprises at least one compound selected from the compounds represented by the formulae (I), (II) and (III):

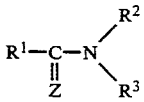

(I)

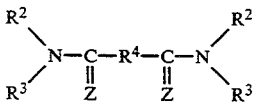

(II)

-continued

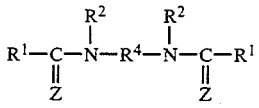

(III)

wherein Z represents a sulfur atom or an oxygen atom, $R^1$ represents an alkyl group, an alkoxy group, a single ring or double condensed ring aryl group, a single ring or a double condensed ring aryloxy group, or a univalent group derived from a heterocyclic ring, and the two $R^1$ groups in general formula (III) may be the same or different;

$R^2$ and $R^3$ each represent a hydrogen atom, an alkyl group, a single ring or double condensed ring aryl group, or a univalent group derived from a heterocyclic ring, and $R^2$ and $R^3$ may be the same or different;

$R^4$ represents a methylene group, a polymethylene group, a branched alkanediyl group or an arylene group, and $R^1$ and $R^2$, or $R^2$ and $R^3$ may be bonded together.

2. An electrophotographic printing plate precursor as in claim 1, wherein said binder resin is a copolymer derived from at least one methacrylic acid ester or acrylic acid ester having an aromatic ring as a monomer component and at least one vinyl polymerizable compound having an acidic functional group as a monomer component, a copolymer derived from at least one vinyl ester compound having an aromatic ring as a monomer component and at least one vinyl polymerizable compound having an acidic group as a monomer component, or a copolymer derived from at least one compound obtained by the half esterification of maleic anhydride with an alcohol having an aromatic ring within the alcohol molecule as a monomer component and at least one styrene derivative as a monomer component.

3. An electrophotographic printing plate precursor as in claim 1, wherein said phthalocyanine pigment is an x-type non-metal phthalocyanine.

4. An electrophotographic printing plate precursor as in claim 1, wherein the phthalocyanine pigment content of the photoconductive layer is from 3 to 50 wt % of the solid fraction of the photoconductive layer.

5. An electrophotographic printing plate precursor as in claim 1, wherein the binder resin content of the photoconductive layer is from 97 to 50 wt % of the solid fraction of the photoconductive layer.

6. An electrophotographic printing plate precursor as in claim 1, wherein said compounds represented by the formulae (I), (II) and (III) act as sensitizing agents which increase the photoconductivity of the photoconductive layer.

7. An electrophotographic printing plate precursor as in claim 1, wherein said compounds represented by the formulae (I), (II) and (III) are added in an amount of from 1 to 100 wt % with respect to the phthalocyanine pigment content.

* * * * *